US012674367B2

(12) United States Patent
Abel et al.

(10) Patent No.: US 12,674,367 B2
(45) Date of Patent: Jul. 7, 2026

(54) DOWNHOLE WIRELINE RECOVERY TOOL AND METHOD OF RECOVERING DOWNHOLE WIRELINES

(71) Applicant: Saudi Arabian Oil Company, Dhahran (SA)

(72) Inventors: Justin Tate Abel, Austin, TX (US); Emad Abbad M. Alabbad, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 1195 days.

(21) Appl. No.: 17/588,497

(22) Filed: Jan. 31, 2022

(65) Prior Publication Data

US 2023/0243225 A1 Aug. 3, 2023

(51) Int. Cl.
*E21B 31/12* (2006.01)
*E21B 31/20* (2006.01)

(52) U.S. Cl.
CPC ..... *E21B 31/125* (2013.01); *E21B 31/20* (2013.01)

(58) Field of Classification Search
CPC ..... E21B 31/125; E21B 31/20; E03C 1/302
See application file for complete search history.

(56) References Cited

U.S. PATENT DOCUMENTS 2,454,884 A * 11/1948 Peaden ..... E03C 1/302 15/104.31
3,029,098 A 4/1962 Sonnier
4,093,294 A 6/1978 Taylor
5,265,676 A 11/1993 Harrell
6,848,507 B2 2/2005 Huggins et al.
7,946,348 B2 * 5/2011 Swinford ..... E21B 31/00 166/301

(Continued)

FOREIGN PATENT DOCUMENTS

CN 112696165 A * 4/2021 ..... E21B 31/125
EP 2085570 B1 6/2017

(Continued)

OTHER PUBLICATIONS

CTT Rotating Tool (Patented), CTT Coil Tubing Technology, Inc., https://www.coiltubingtechnology.com/wp-content/uploads/2019/07/21CTT_Rotating_Tool.pdf (last visited Jul. 23, 2021).

(Continued)

*Primary Examiner* — Daniel Jeremy Leeds
(74) *Attorney, Agent, or Firm* — Dinsmore & Shohl, LLP.

(57) ABSTRACT

A wireline recovery tool for retrieving a wireline from a wellbore includes an outer sheath and a rotatable spear positioned within the outer sheath. The rotatable spear includes a plurality of angled portions and a plurality of vertical portions such that the rotatable spear has an asymmetrical profile. The outer sheath includes a first and second wall, each of which includes an inner surface and an outer surface. A plurality of angled prongs extend from the inner surfaces of the first and second walls. A torque device including an indexing mechanism and ratcheting mechanism rotates the rotational spear positioned within the outer sheath. As the rotatable spears rotates, the wireline being retrieved from the wellbore becomes increasingly entangled with the rotatable spear and outer sheath, such that the wireline can be removed from the wellbore.

14 Claims, 8 Drawing Sheets

(56) References Cited

U.S. PATENT DOCUMENTS

| | | | |
|---|---|---|---|
| 9,637,992 | B2 | 5/2017 | Thomas et al. |
| 9,869,152 | B2 | 1/2018 | Gamstedt et al. |
| 2021/0047888 | A1 | 2/2021 | Schicker |

FOREIGN PATENT DOCUMENTS

| | | | |
|---|---|---|---|
| RU | 2664079 | C2 | 8/2018 |
| WO | 2012119186 | A1 | 9/2012 |

OTHER PUBLICATIONS

FETOUI "Slickline Services Tools—Part 1", Production Technology (Nov. 29, 2017), https://production-technology.org/slickline-service-tools/.

Fishing Tools, National Oilwell Varco, pp. 1-52, downhole@nov.com, 2010.

Summary of First Examination Report received in corresponding Saudi Arabian Application 123441156, received Mar. 27, 2025, pp. 1-4.

* cited by examiner

DOWNHOLE WIRELINE RECOVERY TOOL AND METHOD OF RECOVERING DOWNHOLE WIRELINES

TECHNICAL FIELD

The present specification generally relates to wireline recovery tools for slickline fishing operations, and more specifically to mechanically operable downhole wireline recovery tools.

BACKGROUND

Slickline fishing operations are common events due to various issues encountered during well interventions, which may cause wireline to become stuck or lost in a well. Based on the conditions and the nature of the wireline lost in the hole, multiple recovery tools may be required to recover the wireline. In many cases, retrieving the wireline requires a trial-and-error method of tool selection to determine the geometry and condition of the wire. Thus, a need exists for additional tools or methods to recover the lost wireline because of this challenge.

SUMMARY

In an embodiment, a wire recovery tool for retrieving a wire line mass from a wellbore is disclosed. The wire recovery tool may comprise a stationary sheath having an outer surface and an inner surface, and a plurality of angled prongs which extend from the inner surface. A rotatable spear having a base and a barbed tip may be positioned inside the stationary outer sheath, and a ratcheting mechanism may be used to rotate the rotatable spear. The rotatable spear may further comprise a plurality of angled portions and a plurality of vertical portions such that the rotatable spear has an asymmetrical profile.

In another embodiment, a wire recovery tool for retrieving a wire line mass from a wellbore is disclosed. The wire recovery tool may comprise a stationary sheath having an outer surface and an inner surface, and a plurality of angled prongs which extend from the inner surface. A rotatable spear having a base and a barbed tip may be positioned inside the stationary outer sheath, and a ratcheting mechanism may be used to rotate the rotatable spear. An indexing mechanism may be connected to the ratcheting mechanism, such that vertical motion in the indexing mechanism is translated into rotational motion in the ratcheting mechanism. The rotatable spear may further comprise a plurality of angled portions and a plurality of vertical portions such that the rotatable spear has an asymmetrical profile.

Additionally, a method is disclosed. The method may first involve identifying features of the wire line mass to be retrieved from the wellbore. A wireline recovery tool having a rotatable spear positioned within a stationary outer sheath may then be inserted into the wellbore. The method may next involve compressing the wire line mass into a nest and engaging the wireline mass with the rotatable spear of the wireline recovery tool. Once the rotatable spear has engaged the wire line mass, the method may involve rotating the rotatable spear of the wireline recovery tool such that the wire line mass becomes entangled around the rotatable spear and within the stationary outer sheath. With the wire line entangled, the method may involve raising the recovery tool and weighing the wire line mass to determine if the wire line mass has been captured by the rotatable spear and stationary outer sheath and removing the wire line mass and wireline recovery tool from the wellbore.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
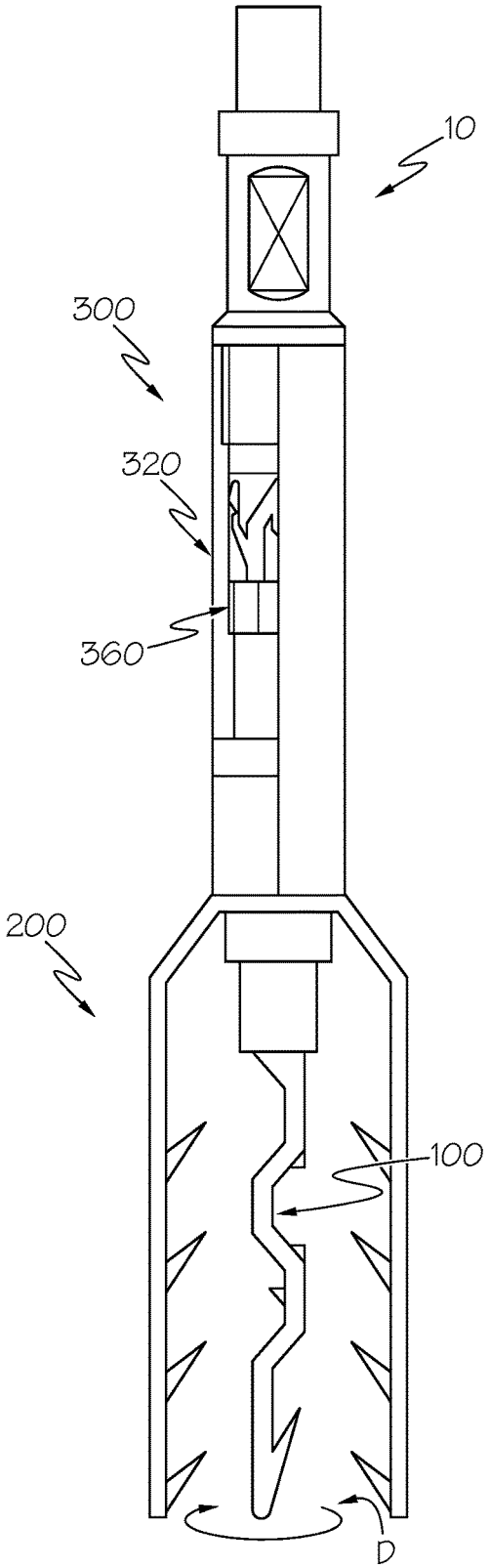
FIG. 1 depicts a front view of a wireline recovery tool, according to one or more embodiments shown and described herein.

Embodiments disclosed herein relate to wireline recovery tools and methods of recovering wirelines from a downhole well. More specifically, the present disclosure includes a mechanically operable wireline recovery tool having an outer sheath and a rotatable spear configured to engage and wrap around the wireline being recovered from the downhole well. In some embodiments, the recovery tool may include a torque device comprising an indexing mechanism and a ratcheting mechanism, which may be configured to rotate the rotatable spear such that the spear may wrap around the wireline being recovered from the downhole well.

As described in more detail herein, the wireline recovery tool may be run into a wellbore and into contact with the wireline being recovered. A fullbore, such as a fullbore blind box, may be use to compress the wireline into a "nest" or "ball," which may be hooked by the rotatable spear of the recovery tool. Once the rotatable spear has engaged the wireline, the wireline may be picked up, such that the weight of the wireline activates the indexing mechanism. With the indexing mechanism activated, the wireline may be set down, which may cause the ratcheting mechanism to rotate about its axis a fixed increment. As the ratcheting mechanism rotates, the rotatable spear may become increasingly entangled with the wireline. In some embodiments, the wireline may be repeatedly picked up and set down until the indexing mechanism has rotated the rotatable spear 360 degrees, at which point the wireline and wireline recovery tool may be removed from the wellbore.

As provided herein, the term "wireline" may refer to multi-conductor, single conductor, or slickline cable run into a wellbore. The wireline may be configured to convey subsurface data, such as petrophysical or geophysical data, and/or provide well construction surfaces including pipe recovery, perforating, plug setting, well cleaning, and fishing. Wirelines may comprise varying rope sockets, stems, and jars, and may be designed to conform to geometric restrictions of a particular wellbore. As described herein, the term wireline may further comprise tool strings and any other cables used to lower tools into a wellbore and to transmit data.

As provided herein, the term "fish" may refer to anything left in a wellbore, particularly a portion of wireline. Once the wireline is lost within the wellbore, the wireline may be referred to as the "fish." Prior to conducting wellbore operations, any components put into the hole (e.g., the wireline) may be measured and sketched, such that appropriate fishing tools may be selected if the components must be fished out of the hole.

Additionally, the term "wireline recovery tool," "wireline grab" or "wireline tool" may refer to a fishing tool used for the retrieval of a fish, such as a broken or cut wireline, from a well bore. Wireline grabs may be intended to catch and engage wireline that has been bunched or nested in the wellbore, and are often utilized after a fullbore tool has been used to nest the wireline.

Notably, wireline recovery tools are typically run independent of other fishing accessories or components. Wireline recovery tools may comprise a plurality of teeth, or angled prongs, which makes it very difficult to introduce an internal component, such as a spear, within the wireline recovery tool. However, in accordance with an embodiment of the present invention, spear having a crooked or non-linear form may be positioned between the plurality of prongs of the wireline recovery tool, such that the spear is capable of rotational movement without colliding with the plurality of prongs of the wireline recovery tool. By combining the wireline grab with the rotatable spear, the probability of effectively entangling the fish (e.g. wireline) within the wireline recovery tool may be increased.

Embodiments of the wireline recovery tool and methods of recovering downhole wirelines will now be described in more detail herein. The following will now describe these tools and methods in more detail with reference to the drawings and where like numbers refer to like structures.

Referring to FIG. 1, a wireline recovery tool 10 for recovering a fish, such as a wireline, lost downhole in a wellbore is illustrated. The wireline recovery tool 10 may include a rotatable spear 100 and an outer sheath 200, such as a wireline grab. In some embodiments, the rotatable spear 100 may be positioned inside the outer sheath 200, such that the rotatable spear 100 may rotate about its axis in a direction D, such as a clockwise direction, within the outer sheath 200. In these embodiments, the outer sheath 200 may be stationary, such that the outer sheath 200 is incapable of moving in a rotational direction as the rotatable spear 100 rotates within the outer sheath 200.

The wireline recovery tool 10 may further comprise a torque device 300 comprising an indexing mechanism 320 and a ratcheting mechanism 360, which may work in tandem to rotate the rotatable spear 100 in the direction D. The torque device 300 may act as a linear to rotary motion converter, which converts linear motion within the indexing mechanism 320 to rotary motion within the ratcheting mechanism 360. The ratcheting mechanism 360 may in turn rotate the rotatable spear 100, such that the spear may become increasingly entangled with the wireline being retrieved from the wellbore.

Figure 2:
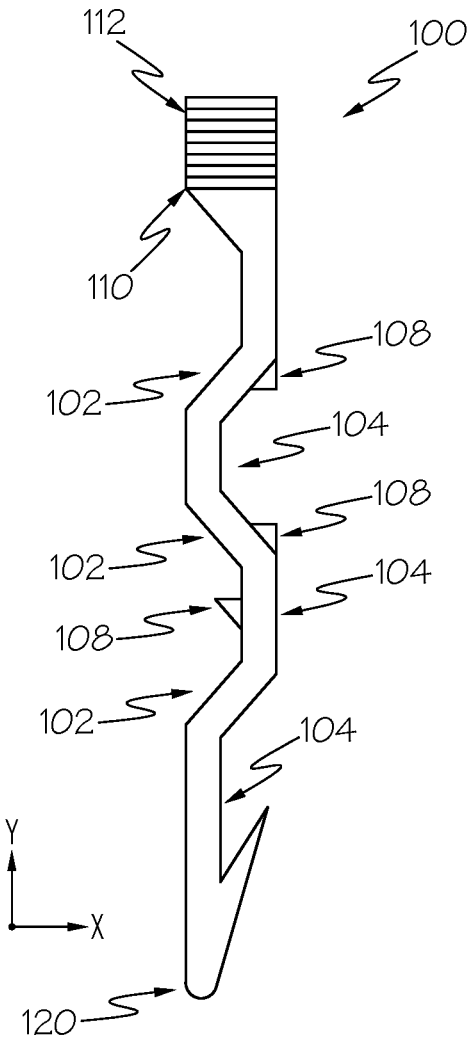
FIG. 2 depicts a rotatable spear of the wireline recovery tool of FIG. 1, according to one or more embodiments shown and described herein.

Referring now to FIG. 2, the rotatable spear 100 of the wireline recovery tool 10 is illustrated. The rotatable spear 100 may comprise a base 110 and a tip 120, such as a barbed tip, which may be configured to engage the wireline lost in the wellbore. In some embodiments, the base 110 may comprise a threaded upper portion 112, which may be configured to connect the rotatable spear 100 to the ratcheting mechanism 360, such that the rotatable spear 100 may rotate in the direction D along with the ratcheting mechanism 360.

As further illustrated in FIG. 2, the rotatable spear 100 may comprise a plurality of angled portions 102 and a plurality of vertical portions 104, such that the rotatable spear has an asymmetrical profile. For example, FIG. 2 illustrates the rotatable spear having three angled portions 102 and three vertical portions 104. However, it should be understood that the rotatable spear may comprise any number of angled and/or vertical portions. Furthermore, although the rotatable spear 100 illustrated in FIG. 2 includes an equal number of angled portions 102 and vertical portions 104, it should be understood that the rotatable spear 100 may include a different number of angled portions 102 and vertical portions 104 (e.g., two angled portions and one vertical portion, three angled portions and two vertical portions, etc.).

In some embodiments, the rotatable spear 100 may further comprise a plurality of barbs 108 affixed to the plurality of angled portions 102 and/or the plurality of vertical portions 104. In these embodiments, the plurality of barbs 108 may be positioned such that a tip of each of the plurality of barbs 108 is angled upwardly towards the base 110 of the rotatable spear 100. As the rotatable spear 100 rotates in the direction D, the plurality of barbs 108 may further assist in entangling the spear 100 within the wireline being recovered from the wellbore.

Referring still to FIG. 2, in some embodiments the plurality of angled portions 102 and the plurality of vertical portions 104 may lie in a single plane, such that the profile of the rotatable spear 100 is substantially flat. For example, as illustrated in FIG. 2, the plurality of angled portions 102 and plurality of vertical portions 104 may all lie within the x-y plane. However, in other embodiments, the plurality of angled portions 102 and the plurality of vertical portions 104 may lie in multiple planes, such that the plurality of angled portions 102 and plurality of vertical portions 104 provide the rotatable spear 100 with a defined depth in multiple planes.

Figure 3:
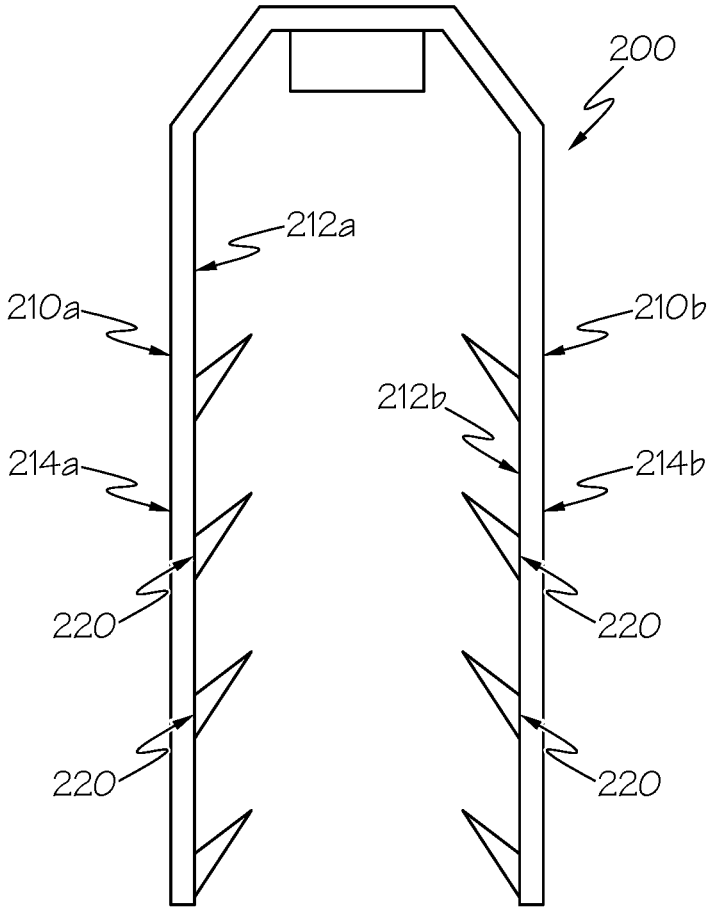
FIG. 3 depicts an outer sheath of the wireline recovery tool of FIG. 1, according to one or more embodiments shown and described herein.

Referring now to FIG. 3, the outer sheath 200 of the wireline recovery tool 10 is illustrated. The outer sheath 200 may comprise a first wall 210*a* and second wall 210*b*, each of which comprise an inner surface 212*a*, 212*b* and an outer surface 214*a*, 214*b*, respectively. A plurality of prongs 220, such as angled prongs, may be positioned on the inner surface 212*a*, 212*b* of the first and second walls 210*a*, 210*b*. In these embodiments, the angled prongs may be angled upwardly towards the base of the rotatable spear 100, such that the plurality of prongs 220 may secure any portion of the wireline that may become entangled within the outer sheath 200. In some embodiments, the plurality of angled prongs 220 may be radially opposed, such that the plurality of prongs 220 effectively surround the rotatable spear 100.

The first wall 210*a* and second wall 210*b* may be spaced apart a distance which is sufficient to allow the rotatable spear 100 to rotate freely in the direction D without interfering with the plurality of prongs 220 positioned on the inner surfaces 212*a*, 212*b* of the first and second wall 210*a*, 210*b*, respectively. Thus, it should be understood that the first and second wall 210*a*, 210*b* of the outer sheath 200 may be spaced apart any distance which is sufficient to accommodate a rotatable spear 100 having a particular width. For example, the first and second wall 210*a*, 210*b* of the outer sheath 200 may be spaced apart a distance which allows for at least one inch of clearance between the rotatable spear 100 and the inner surfaces 212*a*, 212*b* of the first and second walls 210*a*, 210*b*.

Referring still to FIG. 3, the outer sheath 200 may be configured such that the sheath 200 is stationary. In these embodiments, the sheath 200 may be affixed to the torque device 300 such that sheath 200 is incapable of moving in a rotational, horizontal, or vertical direction. The outer sheath 200 may comprise an opening in an upper portion of the sheath 200, such that the threaded upper portion 112 of the rotatable spear 100 may pass through the opening and connect to the ratcheting mechanism 360. In this configuration, the rotatable spear 100 may be free to rotate in the direction D while the outer sheath 200 remains stationary. However, in other embodiments the outer sheath 200 may be affixed to the torque device 300 in such a way that the outer sheath 200 may also rotate along with the rotatable spear 100. In these embodiments, the ratcheting mechanism 360 may rotate the outer sheath 200 and rotatable spear 100 in unison in the direction D. In these embodiments, the threaded upper portion 112 of the outer sheath 200 may include a left-handed thread, such that rotation of the outer sheath 200 does not cause the wireline recovery tool 10 to become disassembled.

Although FIG. 3 illustrates the outer sheath 200 as comprising a first wall 210*a* and second wall 210*b*, the outer sheath 200 may take other structural forms. For example, in some embodiments the outer sheath 200 may comprise a cylindrical structure with a hollow interior, such that the rotatable spear 100 is contained within the cylindrical structure of the outer sheath 200. In these embodiments, the sheath 200 may comprise an inner surface and an outer surface, with the plurality of prongs 220 positioned on the inner surface of the outer sheath 200. It should be understood that the outer sheath 200 may additionally take any number of structural forms, so long as the sheath 200 allows the rotatable spear 100 to rotate within the outer sheath 200.

Figure 4A:
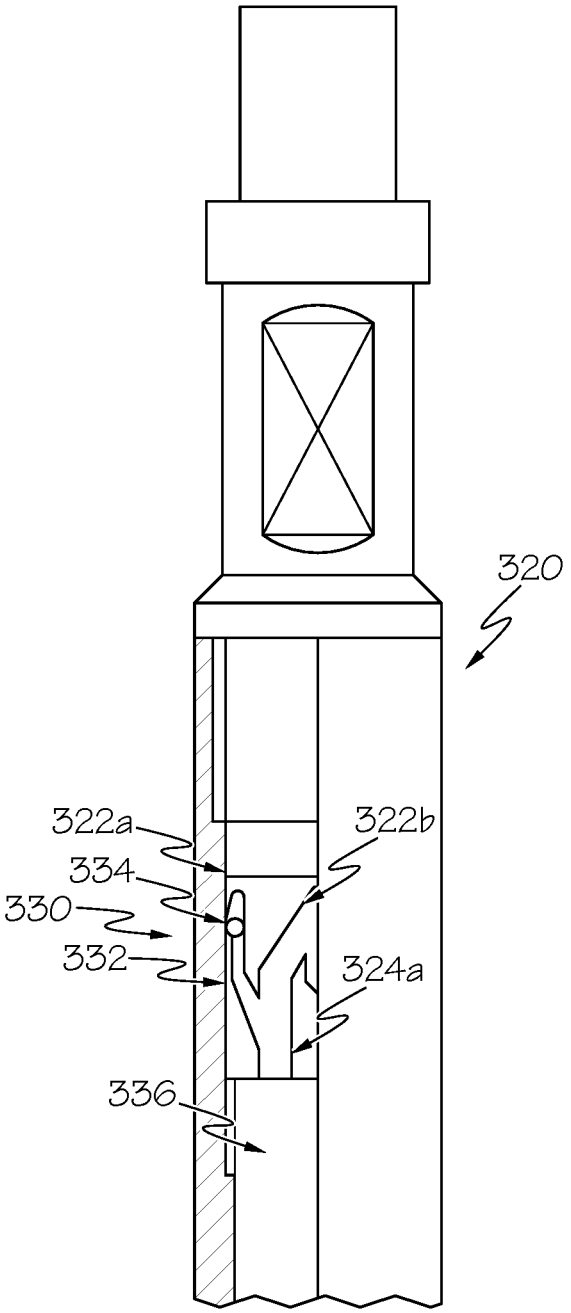
FIG. 4A depicts a partial cross-sectional view of an indexing mechanism of the wireline recovery tool of FIG. 1, according to one or more embodiments shown and described herein.
Figure 4B:
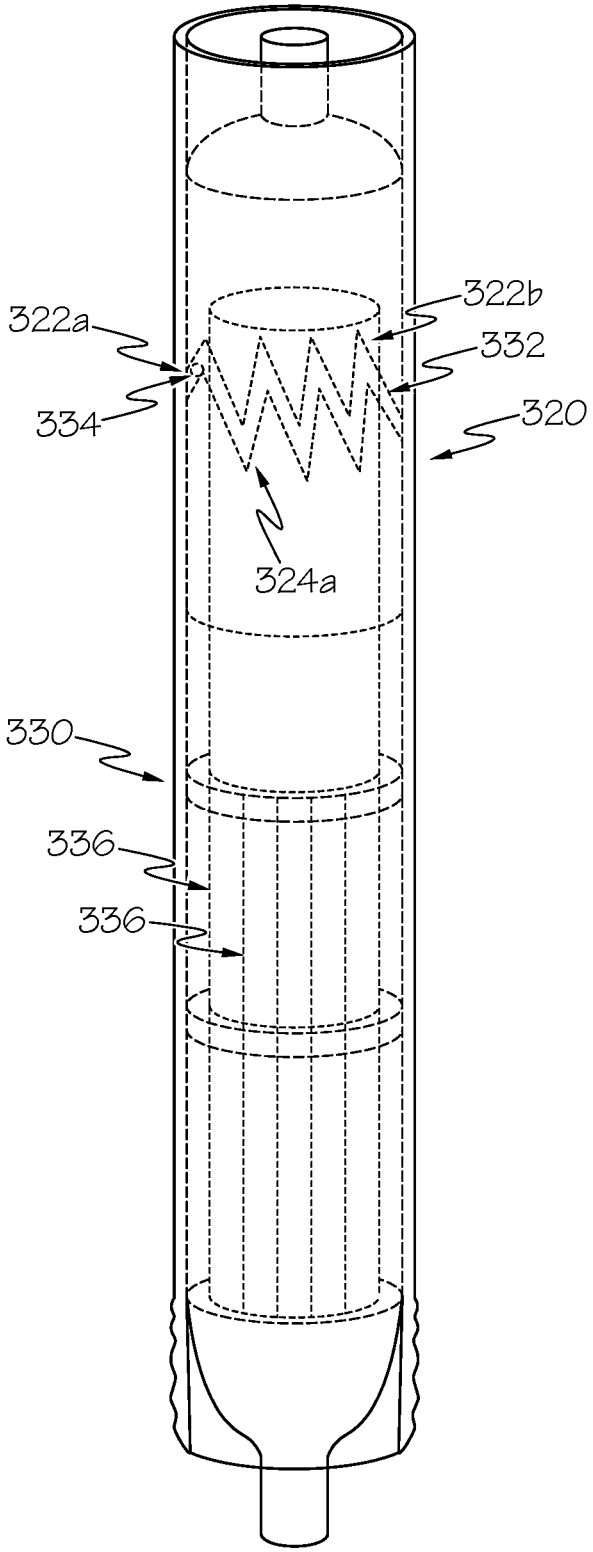
FIG. 4B depicts a perspective view of the indexing mechanism of the wireline recovery tool of FIG. 1.

Referring now to FIGS. 4A-4B, a partial cross-section of the indexing mechanism 320 of the wireline recovery tool 10 is illustrated. The indexing mechanism 320 may comprise a central mandrel 330 having a slot 332 and a pin 334. In some embodiments, the central mandrel 330 may further include a plurality of keys 336 for engaging the ratcheting mechanism 360.

In operation, the indexing mechanism 320 may be activated by lifting the wireline mass once the rotatable spear 100 has engaged the wireline mass. In these embodiments, the central mandrel 330 of the indexing mechanism 320 may be connected to a mechanical actuator or other device capable of lifting the central mandrel 330 in a vertical direction. For example, the mandrel 330 may comprise a connector through which a wireline may be fed in order to couple the recovery tool 10 to the mechanical device being used to lift the recovery tool. In these embodiments, the mandrel connector may be a standard slickline sucker rod thread, such as a ⅞" sucker rod thread, or any other connector suitable for coupling the wireline to the recovery tool 10.

The lifting of the wireline mass may create an upward force on the mandrel 330, which may cause pin 334 to move from a first upper position 322*a* downwardly through slot 332 of the mandrel 330 to a first lower position 324*a*. Once the pin 334 has moved through the slot 332 to the first lower position 322*a*, the wireline mass may be set down, which may relieve the force applied on the mandrel 330. As the upward force on the mandrel 330 is removed, the pin 334 may move upwardly through slot 332 to a second upper position 322*b*. As the pin 334 moves upwardly towards the second upper position 322*b*, the ratcheting mechanism 360 may rotate about its axis in the direction D.

In these embodiments, the movement of the pin 334 between the first upper position 322*a* and second upper position 322*b* may constitute one stroke. Thus, a stroke may include picking up the wireline mass (e.g., moving the pin 334 from the first upper position 322*a* to the first lower position 324*a*) and setting the wireline mass down (e.g., moving the pin 334 from the first lower position 324*a* to the second upper position 322*b*). Each stroke may rotate the ratcheting mechanism 360, and in turn, the rotatable spear 100, a fixed increment.

Figure 5A:
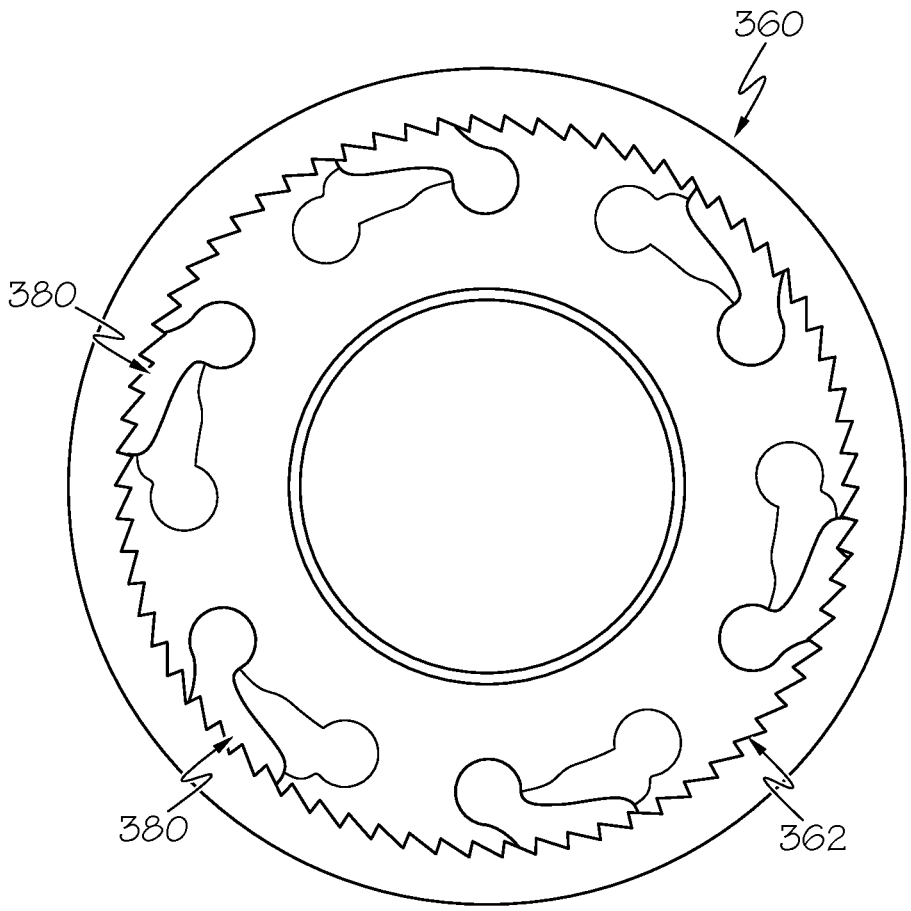
FIG. 5A depicts a cross-sectional view of a ratcheting mechanism of the wireline recovery tool of FIG. 1, according to one or more embodiments shown and described herein.

Referring now to FIG. 5A, a cross-sectional view of the ratcheting mechanism 360 of the wireline recovery tool 10 is illustrated. The ratcheting mechanism 360 may comprise a solid core, such as a metal core, with a plurality of teeth 380. In some embodiments, the plurality of teeth 380 may be spring-loaded, such that the plurality of teeth are capable of being depressed towards an inner surface 362 of the ratcheting mechanism when a force is applied to any of the plurality of teeth 380. The outlines of the plurality of teeth 380 illustrated in FIG. 5 may correspond to the depressed position of the plurality of teeth 380.

Figure 5B:
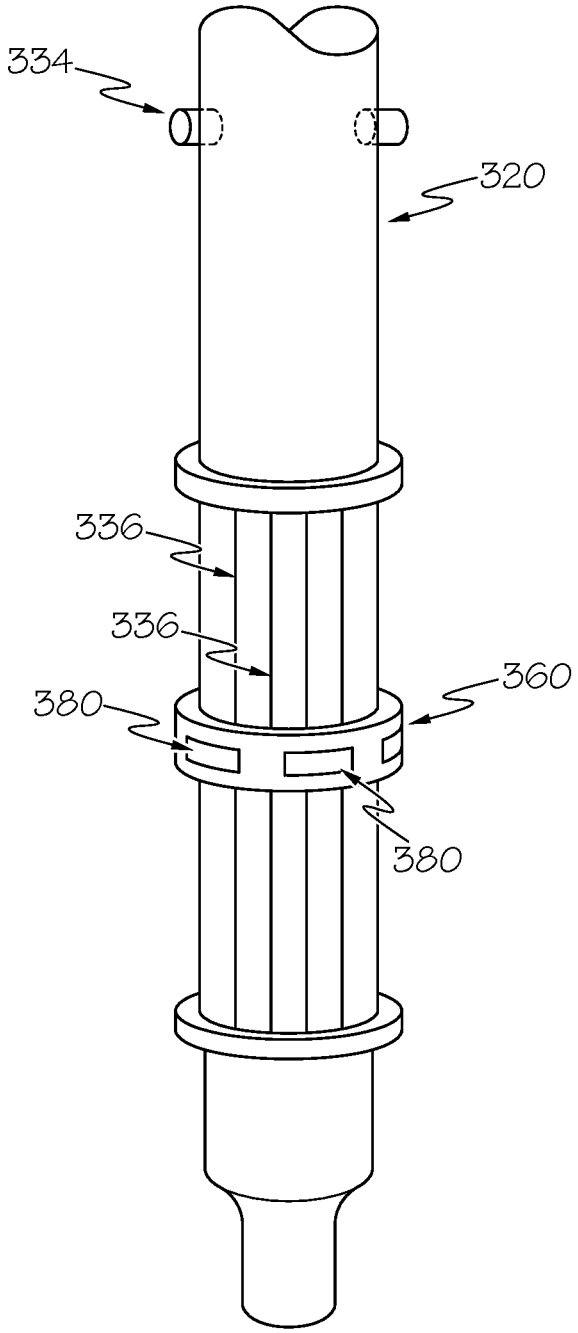
FIG. 5B depicts a perspective view of the indexing mechanism engaging the ratcheting mechanism of the wireline recovery tool of FIG. 1.

In operation, the plurality of keys 336 of the indexing mechanism 320 may engage the plurality of teeth 380 of the ratcheting mechanism 360, as illustrated in FIG. 5B. When the indexing mechanism 320 is activated (e.g., stroked), the ratcheting mechanism 360 may rotate about its axis in the direction D. As the ratcheting mechanism 360 rotates, the plurality of teeth 380 may contact the plurality of keys 336 of the indexing mechanism 320. The contact between the plurality of keys 336 of the indexing mechanism 320 and the plurality of teeth 380 may act to depress the springs of the plurality of teeth 380. As the springs of the plurality of teeth 380 depress, the plurality of teeth 380 may rotate between the plurality of keys 336 and the inner surface of the 362 of the ratcheting mechanism 360. Once the plurality of teeth 380 have rotated past the plurality of keys 336, the plurality of keys 336 may act as a stop which effectively prevents the ratcheting mechanism from rotating in a reverse direction.

In the embodiments described herein, a single one of the plurality of teeth 380 may rotate past the a single one of the plurality of keys 336 in a single stroke. Thus, the ratcheting mechanism 360 may rotate in a complete circle (e.g. 360 degrees) when each of the plurality of teeth 380 has rotated in the direction D past at least one single key of the plurality of keys 336 of the indexing mechanism 320. In these embodiments, the degree of rotation that occurs during each stroke may be a product of the number of the plurality of teeth 380 in the ratcheting mechanism 360. For example, FIG. 5 illustrates the ratcheting mechanism 360 containing six teeth 380. In this embodiment, each stroke may result in the ratcheting mechanism 360 being rotated 60 degrees about its axis in the direction D. However, it should be understood that the embodiment illustrated in FIG. 5 is for illustrative purposes only, and the ratcheting mechanism 360 may comprise any number of teeth 380. For example, the ratcheting mechanism 360 may comprise four teeth 380, such that each stroke results in the ratcheting mechanism 360 rotating 90 degrees about its axis in the direction D. Furthermore, it should be understood that the indexing mechanism may comprise a plurality of keys 336, so long as the number of keys 336 is equal to or less than the number of the plurality of teeth 380.

It should be noted that the mechanically operated torque device 300 described herein provides a number of benefits compared to its electrically driven counterparts. Notably, mechanically operated devices require little maintenance while offering a high degree of accuracy and repeatability that may not be achievable using electrically driven devices. Furthermore, mechanically operated torque devices may be capable of moving heavier loads at faster speeds than many electronic systems, which may be beneficial when retrieving large masses of wireline from a wellbore. Although the use of mechanically operated devices are described herein, it should be understood that these are only exemplary in nature, and any device capable of rotating the rotatable spear 100, whether mechanical, electrical, or otherwise, may be used in the wireline recovery tool 10.

Figure 6:
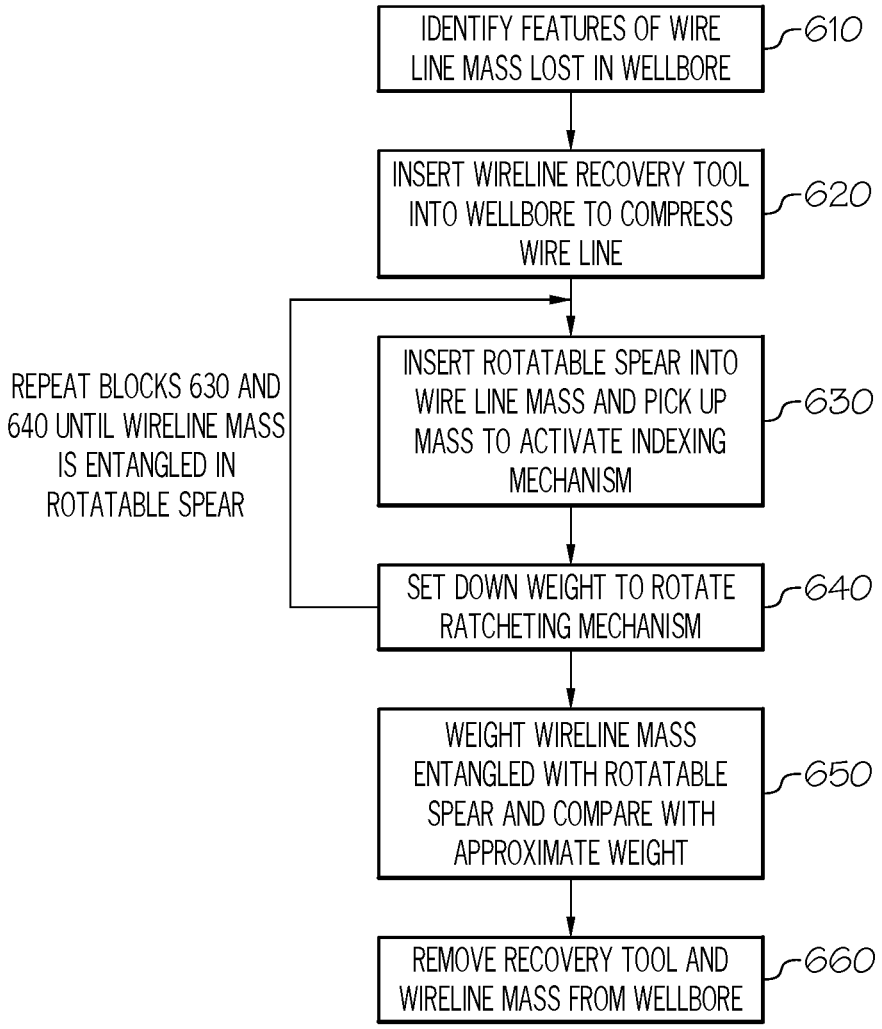
FIG. 6 depicts a flow diagram of an illustrative method for recovering a wireline using the wireline recovery tool of FIG. 1, according to one or more embodiments shown and described herein.

Referring now to FIG. 6, an illustrative flow diagram of an illustrative method for recovering a wireline from a wellbore using the wireline recovery tool 10 is depicted. The method of recovering a wireline using the recovery tool 10 described herein increases the probability of effectively entangling a lost wireline such that the wireline may be removed from the wellbore. In many tools, the use of a spear to retrieve a wireline mass from a wellbore may only allow for engagement of the wireline in a single direction, which may result in the wireline coming loose as the tool is retrieved from the wellbore. By implementing the rotatable spear 100, the spear 100 is capable of engaging the wireline using directional motion and rotational motion. By winding the wireline around the spear 100, the wireline may be more effectively secured to the recovery tool 10 for removal from the wellbore.

Furthermore, combining the rotatable spear 100 with the outer sheath 200 of the wireline recovery tool 10 provides an additional mechanism for securing the wireline if the wireline begins to come loose as the recovery tool 10 is removed from the wellbore. For example, as the wireline becomes entangled with rotatable spear 100, any portion of the wireline that comes loose from the rotatable spear 100 may be secured by the plurality of angled prongs 220 which extend from the inner surfaces 212*a*, 212*b* of the first and second walls 210*a*, 210*b* of the outer sheath 200. By utilizing the rotatable spear 100 and outer sheath 200 in combination, the ability of the recovery tool 10 to successfully capture and retrieve a wireline from a well bore may be dramatically increased.

As illustrated at block 610 of FIG. 6, the method disclosed herein may first involve identifying the details of the wireline mass lost in the wellbore. Prior to inserting the wireline into the wellbore, an initial length of the wireline may be recorded. When the wireline is retrieved, a retrieved length of the wireline may be determined. By comparing the initial length of the wireline to the retrieved length of the wireline, it may be possible to determine the length of the wireline which has been lost in the wellbore. Additionally, it may be possible to approximate the weight of the lost wireline based on the length of the wireline lost in the wellbore.

Once the details of the wireline mass have been identified, the method may proceed to block 620, which may involve inserting the wireline recovery tool 10 into the wellbore to compress the wireline into a "nest" or "ball" which may be hooked by the rotatable spear 100 and outer sheath 200 of the recovery tool. Although the wire recovery tool 10 may be used to compress the wireline, some embodiments may utilize a full bore, or similar tool, to compress the wireline into a "nest" or "ball," after which the wireline recovery tool 10 may be fed into the wellbore to hook the compressed wireline.

After the wireline is compressed, the method may then continue to block 630, which may involve inserting the barbed tip 120 of the rotatable spear 100 into the compressed wireline. With the barbed tip 120 of the rotatable spear 100 inserted into the compressed wireline, the wireline is picked up such that the weight of the compressed wireline may activate the indexing mechanism 320. As previously described herein, as the compressed wireline is lifted, the pin 334 of the indexing mechanism may move through the slot 332 between first upper position 322*a* and first lower position 324*a*.

With the pin 334 in the first lower position 324*a*, the method may proceed to block 640, which may involve setting the compressed wireline down such that the weight of the wireline is no longer acting on the recovery tool 10. As the weight of the wireline is released, the pin 334 may move upwardly from the first lower position 324*a* to the second upper position 322*b*. As the pin 334 moves upwardly, the ratcheting mechanism 360 may rotate concurrently, such that at least one of the plurality of teeth 380 of the ratcheting mechanism 360 rotates about its axis in the direction D past the at least one key 336 of the indexing mechanism 320. As the ratcheting mechanism 360 rotates, the rotatable spear 100 rotates an equal amount, which may allow the rotatable spear 100 to become increasingly entangled with the compressed wireline mass.

Blocks 630 and 640 may be repeated until the ratcheting mechanism 360 has rotated a sufficient amount to allow the rotatable spear 100 to fully entangle the compressed wireline. In some embodiments, blocks 630 and 640 may be repeated until the ratcheting mechanism has completed a full revolution (e.g. 360 degrees) about its axis. However, it may not be necessary for the ratcheting mechanism 360 to complete a full revolution about its axis in the direction D prior to the compressed wireline being removed from the wellbore.

As blocks 630 and 640 of FIG. 6 are repeated, the rotation of the rotatable spear 100 may draw the wireline mass into an entangled relationship with the rotatable spear 100 so that the compressed wireline and rotatable spear 100 may be removed from the wellbore. The continued rotation of the rotatable spear 100 may gradually draw the compressed wire upwardly towards the base 110 of the rotatable spear 100. As the wireline moves upwardly along rotatable spear, the asymmetrical profile of the spear 100 may help ensure that the wireline does not come loose from the spear 100. More specifically, the angled portions 102 of the rotatable spear 100 may resist any tendency for the wireline to slip downwardly along the rotatable spear 100.

Furthermore, as the rotatable spear 100 gradually draws the compressed wireline upwards towards the base 110 of the spear 100, the asymmetrical profile of the spear 100 may cause portions of the compressed wireline to be pushed into contact with the outer sheath 200. More specifically, portions of the compressed wireline may be pushed into contact with the plurality of prongs 220 positioned on the inner surfaces 212*a*, 212*b* of first and second walls 210*a*, 210*b*, respectively. As a result, the rotation of the rotatable spear 100 may not only act to entangle the compressed wireline around the spear, but may also serve to engage the compressed wireline with the plurality of prongs 220 of the outer sheath 200.

Once the wireline is sufficiently entangled with the rotatable spear 100 and the outer sheath 200, the wireline may be picked up and weighed, as illustrated at block 650. In some embodiments, the recovery tool 10 may comprise a weighing mechanism, such as a pressure sensor, which may be configured to determine the weight of the wireline captured by the recovery tool. In these embodiments, the weight of the wireline may be determined by measuring wireline tension at the surface of the wellbore using a plurality of mechanical and/or electronic strain gauges. The weight of wireline entangled with the rotatable spear 100 and outer sheath 200 may be compared to the approximated weight of the lost wireline determined at block 610.

When the weight of the wireline entangled with the rotatable spear 100 and outer sheath 200 is within a threshold of the approximate weight of the lost wireline, the recovery tool 10 and wireline may be removed from the wellbore, as illustrated at block 660. For example, the wireline may be removed from the wellbore when the weight of the wireline is equal to the weight of the wireline being recovered from the wellbore plus the weight of the recovery tool 10. Additionally, in instances in which the wireline recovery tool 10 is unable to adequately recover the lost wireline, the recovery tool 10 may be retrieved from the wellbore to check for wear marks or other issues. In these embodiments, the recovery tool 10 may be equipped with different outer sheath 200 and/or rotatable spear 100 configurations prior to being reinserted in the wellbore.

As should be appreciated in view of the foregoing, a wireline recovery tool is described herein. A first aspect of the disclosure may include a wireline recovery tool for retrieving a wireline mass from a well bore. The wireline recovery tool may include a stationary outer sheath having an outer surface and an inner surface, the outer sheath further having a plurality of angled prongs extending from the inner surface, a rotatable spear having a base and a barbed tip, the rotatable spear positioned inside the stationary outer sheath, and a torque device including for rotating the rotatable spear. The rotatable spear may have a plurality of angled portions and a plurality of vertical portions such that the rotatable spear has an asymmetrical profile.

A second aspect of the disclosure may include the first aspect, wherein the plurality of angled portions and the plurality of vertical portions of the rotatable spear lie in a single plane.

The third aspect of the disclosure may include any of the first or second aspects, wherein the plurality of angled portions and the plurality of vertical portions of the rotatable spear further comprise a plurality of barbs angled towards the base of the rotatable spear.

The fourth aspect of the disclosure may include any of the first through third aspects, wherein the rotatable spear further comprises a threaded upper portion for engaging the torque device.

The fifth aspect of the disclosure may include any of the first through fourth aspects, wherein the stationary outer sheath further comprises a first wall and a second wall each having an inner surface and an outer surface.

The sixth aspect of the disclosure may include any of the first through fifth aspects, wherein the plurality of angled prongs extending from the inner surface of the outer sheath are radially opposed.

The seventh aspect of the disclosure may include any of the first through sixth aspects, wherein the plurality of angled prongs are angled towards a base of the rotatable spear.

The eighth aspect of the disclosure may include any of the first through seventh aspects, wherein the torque device comprises a ratcheting mechanism having a plurality of spring-loaded teeth such that the plurality of teeth can be depressed towards an inner surface of the ratcheting mechanism.

The ninth aspect of the disclosure may include any of the first through eighth, wherein the torque device further comprises an indexing mechanism having a mandrel with a pin and a slot, the slot including a first upper position, a first lower position, and a second lower position.

The tenth aspect of the disclosure may include the ninth aspect, wherein the motion of the pin between the first upper position, first lower position, and second upper position causes the indexing mechanism to rotate the ratcheting mechanism about its axis.

The eleventh aspect of the disclosure may include the tenth aspect, wherein the indexing mechanism further includes at least one key which contacts the at least one of the plurality of teeth of the ratcheting mechanism, such that the at least one key prevents the ratcheting mechanism from counter-rotating about its axis.

A twelfth aspect of the disclosure may include a wireline recovery tool for retrieving a wireline mass from a well bore. The wireline recovery tool may include a stationary outer sheath having an outer surface and an inner surface, the outer sheath further having a plurality of angled prongs extending from the inner surface; a rotatable spear having base and a barbed tip, the rotatable spear positioned inside the stationary outer sheath; a ratcheting mechanism for rotating the rotatable spear; and an indexing mechanism connected to the ratcheting mechanism. The indexing mechanism may be operable to translate vertical motion in the indexing mechanism into rotational motion in the ratcheting mechanism, and the rotatable spear may have a plurality of angled portions and a plurality of vertical portions such that the rotatable spear has an asymmetrical profile.

A thirteenth aspect of the disclosure may include the twelfth aspect, wherein the plurality of angled portions and the plurality of vertical portions of the rotatable spear lie in a single plane.

A fourteenth aspect of the disclosure may include the twelfth or thirteenth aspect, wherein the rotatable spear further comprises a threaded upper portion for engaging the ratcheting mechanism.

A fifteenth aspect of the disclosure may include any of the twelfth through fourteenth aspects, wherein the plurality of angled prongs extending from the inner surface of the outer sheath are radially opposed.

A sixteenth aspect of the disclosure may include any of the twelfth through fifteenth aspects, wherein the ratcheting mechanism further comprises a plurality of spring-loaded teeth such that the plurality of teeth can be depressed towards an inner surface of the ratcheting mechanism.

A seventeenth aspect of the disclosure includes a method of retrieving a wireline mass from a well bore. The method may include identifying features of the wireline mass to be retrieved from the wellbore; inserting a wireline recovery tool having a rotatable spear positioned within a stationary outer sheath into the wellbore; compressing the wireline mass into a nest; engaging the wireline mass with the rotatable spear of the wireline recovery tool; rotating the rotatable spear of the wireline recovery tool such that the wireline mass becomes entangled around the rotatable spear and within the stationary outer sheath; raising the recovery tool and weighing the wireline mass to determine if the wireline mass has been captured by the rotatable spear and stationary outer sheath; and removing the wireline mass and wireline recovery tool from the wellbore.

An eighteenth aspect of the disclosure may include the seventeenth aspect, wherein the rotatable spear of the wireline recovery tool comprises a plurality of angled portions and a plurality of vertical portions lying within the same plane, and the outer sheath comprises a plurality of angled prongs.

A nineteenth aspect of the disclosure may include the eighteenth or nineteenth aspects, wherein the wireline recovery tool further comprises a ratcheting mechanism for rotating the rotatable spear.

The twentieth aspect of the disclosure may include any of the seventeenth through nineteenth aspects, wherein rotating the rotatable spear further involves repeatedly picking up the wireline mass to engage a torque device of the wireline recovery tool and setting down the wireline mass to rotate the rotatable spear.

The terminology used herein is for the purpose of describing particular aspects only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A wireline recovery tool for retrieving a wireline mass from a well bore, comprising:

a stationary outer sheath having an outer surface and an inner surface, the outer sheath further having a plurality of angled prongs extending from the inner surface;

a rotatable spear having a base and a barbed tip, the rotatable spear positioned inside the stationary outer sheath; and a torque device including for rotating the rotatable spear, wherein:

the rotatable spear has a plurality of angled portions and a plurality of vertical portions such that the rotatable spear has an asymmetrical profile, the rotatable spear comprises a plurality of barbs angled upwardly towards the base of the rotatable spear, angled downwardly towards the barbed tip, or at least some angled upwardly towards the base of the rotatable spear and some others angled downwardly towards the barbed tip, and the plurality of barbs are positioned on the angled portions and the vertical portions of the asymmetrical profile.

2. The wireline recovery tool of claim 1, wherein the plurality of angled portions and the plurality of vertical portions of the rotatable spear lie in a single plane.

3. The wireline recovery tool of claim 1, wherein the rotatable spear further comprises a threaded upper portion for engaging the torque device.

4. The wireline recovery tool of claim 1, wherein the stationary outer sheath further comprises a first wall and a second wall each having an inner surface and an outer surface.

5. The wireline recovery tool of claim 1, wherein the plurality of angled prongs extending from the inner surface of the outer sheath are radially opposed.

6. The wireline recovery tool of claim 1, wherein the plurality of angled prongs are angled upwardly towards a base of the rotatable spear.

7. The wireline recovery tool of claim 1, wherein the torque device comprises a ratcheting mechanism having a plurality of spring-loaded teeth such that the plurality of teeth can be depressed towards an inner surface of the ratcheting mechanism.

8. The wireline recovery tool of claim 7, wherein the torque device further comprises an indexing mechanism having a mandrel with a pin and a slot, the slot including a first upper position, a first lower position, and a second lower position.

9. The wireline recovery tool of claim 8, wherein the motion of the pin between the first upper position, first lower position, and second upper position causes the indexing mechanism to rotate the ratcheting mechanism about its axis.

10. The wireline recovery tool of claim 9, wherein the indexing mechanism further includes at least one key which contacts the at least one of the plurality of teeth of the ratcheting mechanism, such that the at least one key prevents the ratcheting mechanism from counter-rotating about its axis.

11. A method of retrieving a wireline mass from a well bore comprising:

identifying features of the wireline mass to be retrieved from the wellbore;

inserting a wireline recovery tool having a rotatable spear positioned within a stationary outer sheath into the wellbore;

compressing the wireline mass into a nest;

engaging the wireline mass with the rotatable spear of the wireline recovery tool; and rotating the rotatable spear of the wireline recovery tool via a torque device included for rotating the rotatable spear, such that the wireline mass becomes entangled around the rotatable spear and within the stationary outer sheath, wherein:

the stationary outer sheath has an outer surface and an inner surface, the outer sheath further having a plurality of angled prongs extending from the inner surface;

the rotatable spear has a base and a barbed tip, the rotatable spear has a plurality of angled portions and a plurality of vertical portions such that the rotatable spear has an asymmetrical profile, the rotatable spear comprises a plurality of barbs angled upwardly towards the base of the rotatable spear, angled downwardly towards the barbed tip, or at least some angled upwardly towards the base of the rotatable spear and some others angled downwardly towards the barbed tip, and the plurality of barbs are positioned on the angled portions and the vertical portions of the asymmetrical profile.

12. The method of claim 11, wherein the plurality of angled portions and the plurality of vertical portions lie in a single plane.

13. The method of claim 11, wherein the wireline recovery tool further comprises a ratcheting mechanism for rotating the rotatable spear.

14. The method of claim 11, wherein rotating the rotatable spear further involves repeatedly picking up the wireline mass to engage the torque device of the wireline recovery tool and setting down the wireline mass to rotate the rotatable spear.

* * * * *